United States Patent [19]

Hubbert et al.

[11] Patent Number: 4,572,507

[45] Date of Patent: Feb. 25, 1986

[54] GAME BALL

[75] Inventors: David W. Hubbert, Perkasie, Pa.; Bobby L. Robinson, Vidalia, Ga.

[73] Assignee: Athlone Industries, Inc., Parsippany, N.J.

[21] Appl. No.: 569,856

[22] Filed: Jan. 11, 1984

Related U.S. Application Data

[63] Continuation-in-part of Ser. No. 551,828, Nov. 15, 1983, abandoned.

[51] Int. Cl.[4] ..... A63B 37/00; A63B 37/02

[52] U.S. Cl. ..... 273/60 R; 264/46.9; 156/172; 521/144; 521/149; 273/DIG. 22

[58] Field of Search ..... 273/60 R, 60 A, 60 B, 273/222, 223, 224, 225, 226, 227, 230, DIG. 22, 58 A

[56] References Cited

U.S. PATENT DOCUMENTS

| | | | |
|---|---|---|---|
| 709,411 | 9/1902 | Kempshall | 273/225 |
| 713,769 | 11/1902 | Kempshall | 273/225 X |
| 2,175,685 | 10/1939 | Dieterich | 273/227 X |
| 3,421,766 | 1/1969 | Chmiel et al. | 273/218 |
| 4,364,565 | 12/1982 | Tomar | 273/60 R |
| 4,367,873 | 1/1983 | Chang et al. | 273/60 R |

FOREIGN PATENT DOCUMENTS

| | | | |
|---|---|---|---|
| 705017 | 3/1965 | Canada | 273/222 |

*Primary Examiner*—George J. Marlo

*Attorney, Agent, or Firm*—Robin, Blecker & Daley

[57] ABSTRACT

A ball, such as a baseball or softball, which includes a thermoplastic resin center, an outer winding and a two-piece cover is disclosed. The core comprises at least 45% of a partially blown copolymer of at least one olefin with at least one unsaturated monocarboxylic acid which is wrapped with a suitable winding impregnated with a latex based adhesive which winding is heat fused to the outer surface of the thermoplastic resin center. The partially blown spherical center has a micro cellular structure wherein the cells increase in number and decrease in size radially outward from the center. The core, consisting of the thermoplastic resin center and winding which is heat fused thereto, is covered with a two-piece stitched cover. The process for making the described ball is also disclosed.

20 Claims, 2 Drawing Figures

GAME BALL

This application is a continuation-in-part of co-pending U.S. Pat. Application, Ser. No. 551,828 filed on Nov. 15, 1983.

BACKGROUND OF THE INVENTION

1. Field of Invention

The present invention is directed to playing balls and more specifically to softballs and baseballs having a combination core made of a foamed thermoplastic resin and an outer winding of yarn which is saturated with a latex based adhesive. The invention also includes the method of producing these balls.

2. Discussion of the Prior Art

In the past, various constructions have been used in the production of softballs and baseballs in order to produce balls having the proper characteristics for the type of play in which they are to be used. For example, conventional softballs have normally included a center made of cork or kapok over which a yarn winding is applied consisting of cotton and synthetic yarn. The wound core is then encased by a two piece stitched cover which may be made of any number of vinyl or rubber materials, but traditionally has been made of leather.

In the case of baseballs, traditional balls of this type have normally included a small cork and rubber starter core about one inch in diameter which is "random wound" with wool or synthetic blends of yarn. A thin layer of cotton finishing yarn is then applied bringing the final core to proper size. A two piece cover is sewn on the core producing a finished ball. Obviously the size, weight,, balance, flight characteristics, durability, resilience and sound of the ball when batted, whether it is a softball or baseball, are determined by the various combinations of core compositions and windings.

Although conventional balls of the type described above have met with varying success, they each suffer from a number of substantial drawbacks. For example, due to the fact that the center core section is relatively soft and therefore easily compressible, the cores have a tendency to deform or flatten when the ball is struck, causing the winding to shift. The shifting of the winding throws the ball out of balance which further degrades the ball. Additionally, due to the shift in winding material, the prior art balls have a tendency to develop soft spots after extended use which causes erratic flight and inconsistent rebound. Various attempts to glue the windings to the center have not met with complete success especially with windings applied to the smooth surface of solid core balls.

Other drawbacks of the prior art balls, and particularly baseballs, is that the yarn wound cores absorb moisture especially during damp or wet playing conditions. Damp yarn causes increased weight, erratic flight, reduced rebound, premature softness and eventual shrinkage. Moreover, since the prior art baseballs are random wound using numerous blends of yarn, it is difficult to set tension on the threads during the winding process, thereby producing broad inconsistencies in size, weight, rebound and density.

In an attempt to overcome the deficiencies of conventional wound balls and in order to reduce the relatively high cost of manufacturing balls having a center and outer windings, manufacturers have begun making balls using a solid plastic core covered with a two-piece stitched cover. Game balls of this type are described in U.S. Pat. No. 4,211,407 as having a core which consists essentially of a single unwound spherical mass of ethylene vinyl acetate copolymer.

Although unwound solid cored balls of this type can be used, it has been found they are extremely hard, and with respect to softballs, are too lively. It has also been found that solid cored balls, due to their surface hardness, subject the outer cover to increased wear and stitching thread breakage. Another drawback encountered is that solid cored balls have a greater tendency to dent aluminum bats particularly when used in cool weather.

If the plastic core is made softer in order to prevent cover splitting and thread breakage, the sound when struck with the bat becomes muffled and no longer audible enough to satisfy the fielding player whose ear is tuned to the sharp sound of a regulation batted ball. This sound is important since the fielding player uses it to judge hit distance while fielding the ball. Moreover, solid cored plastic balls tend to deform if used above the youth level of play.

SUMMARY OF THE INVENTION

The balls of the present invention comprise a core having a spherical center of partially blown thermoplastic resin material surrounded by a yarn winding which is saturated with a latex based adhesive. This core is then covered with a two-piece stitched cover.

The method of the present invention includes forming the plastic center by foam injection molding a mixture of thermoplastic resins such that the core center is developed as a foamed sphere. After forming the center, a yarn winding is applied. The yarn wound center is then immersed in a latex based adhesive until the adhesive saturates the yarn. Thereafter, the yarn wound core is placed into a heat tunnel for approximately one hour at a temperature of about 125° F. to 200° F. and from there to an ironing press where it is heated and compressed for approximately 10 to 20 seconds so that the outer portion of the plastic center is fused to the yarn of the ball. The wound and fused core is then covered with a conventional two piece stitched cover.

Accordingly, it is an object of the present invention to provide durable softballs and baseballs which have satisfactory size, weight, balance, sound, rebound and flight characteristics for all levels of play.

Another object of the present invention is to provide softballs and baseballs which are sufficiently resilient so that they maintain their shape during play while not being unduly lively and maintain the same degree of resilience and performance after extended use.

Still another object of the invention is to provide softballs and baseballs which have a winding which acts as a cushion for the extremely hard surface of the plastic center and does not have a tendency to shift on the center, develop flat spots and prevents undue cover splitting and thread breakage.

Another object of the invention is to provide softballs and baseballs which will meet all required standards of traditional balls of this type, including durability and rebound.

Still another object of the invention is to provide a method of manufacturing the balls of the present invention at competitive prices.

Still other objects and advantages of the present invention will be apparent from the specification and attached drawings.

BRIEF DESCRIPTION OF THE DRAWINGS

The following drawings are for the purpose of illustration, and are in no way deemed to limit the scope of the present invention.

DETAILED DESCRIPTION OF THE PREFERRED EMBODIMENT

Figure 1:
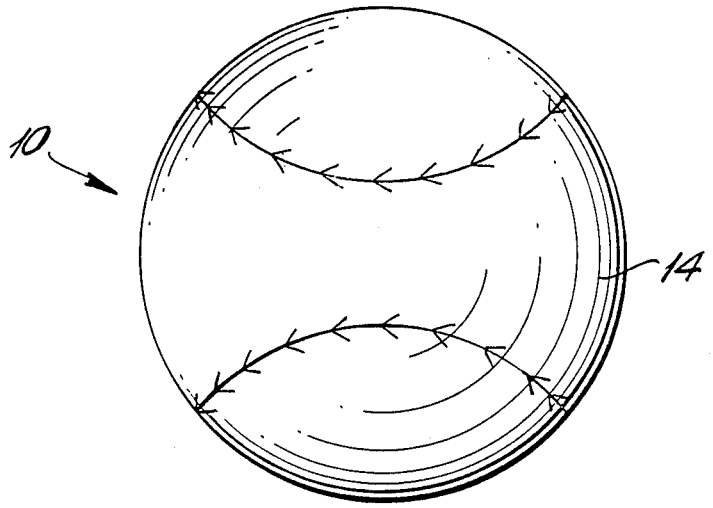
FIG. 1 is a front view of a ball constructed in accordance with the present invention prior to the application of the cover.

The center portion of the core used in the construction of the balls of the present invention comprises a polymer or copolymer of olefinic unsaturated compounds, compounds ultimately derived from olefinic compounds or mixtures of such compounds. These may include, ethylene acrylic acid copolymers, ethylene vinyl acetate copolymers, polyethylene, polypropylene, polycarbonates, polyurethanes, thermoplastic rubber, and similar plastic materials.

Preferably, the plastic center of the present invention includes at least 45% by weight of copolymers of at least one olefin with at least one unsaturated carboxylic acid and can be either random copolymers in which the molecular chains are composed of the different monomers polymerized or can be graft copolymers made by polymerizing the unsaturated carboxylic acid monomer on to a backbone molecular chain of the polyolefin. The copolymer may, if desired, contain small amounts, e.g. less than 10 percent by weight of other monomers such as vinyl alkanoic esters, alkyl acrylates and alkyl methacrylates. Preferably, the olefin contains a small number of carbon atoms in the molecule and a particularly useful copolymer is prepared from ethylene. The unsaturated carboxylic acid can be a dicarboxylic acid but preferably is a monocarboxylic acid, for example acrylic acid, methacrylic acid, itaconic acid, crotonic acid and sorbic acid. Mixtures of different carboxylic acids can be used and metal salts of the acid in which the metal has a valency of from 1 to 4, e.g. sodium or zinc salts, can be used to form terpolymers with the olefin and a free acid. A typical polymer is a terpolymer of ethylene, methacrylic acid and sodium methacrylate.

The copolymers can contain up to 30 percent by weight of the unsaturated carboxylic acid but preferably contain up to 15 percent by weight. Copolymers of the above type which are suitable for use in the present invention are further described in U.S. Pat. No. 3,264,272, issued Aug. 2, 1966, the disclosure of which is hereby included by reference.

The use of ethylene acrylic acid copolymers sold by DuPont under the trademark Surlyn when used in the proportions and in the combinations described in detail below results in balls having extremely well balanced playing characteristics. Generally, however, ionomer resins having the same characteristics and nominal values as does Surlyn may be used in the construction of the center of the present ball. These compounds have the following general characteristics:

| Property | ASTM Method | Nominal Values |
|---|---|---|
| Melt Flow Index* | D-1238 | 1–5 gms/10 min |
| Specific gravity | D-792 | 0.94–0.96 |
| Density | | 0.034–.035 lbs/in$^3$ |

-continued

| Property | ASTM Method | Nominal Values |
|---|---|---|
| Tensile Impact @ 23° C. | D-1822S | 865–1190 ft-lbs/in$^2$ |
| Tensile Impact @ −40° C. | D-1822S | 565–1190 ft-lbs/in$^2$ |
| Hardness, Share D | D-2240 | 55–65 |
| Melting Point | DTA** | 81° C.–96° C. |
| Freezing Point | DTA** | 52° C.–84° C. |

*Dried 16 hours in vacuum oven at 63° C.
**Differential thermal analysis.

More specifically to construct a softball in accordance with the present invention a mixture of about 15% to about 35% of Surlyn 9450 and from about 65% to about 85% of Surlyn 8528, when combined with the appropriate winding, produces a softball having excellent flight and durability characteristics. Preferably a mixture of about 25% Surlyn 9450 and 75% Surlyn 8528 is used in the construction of the present plastic center.

With respect to the composition of the core center of the baseballs constructed in accordance with the present invention, it has been found that a mixture of about 45% to about 55% of the ethylene acrylic acid copolymers described above, and from about 45% to about 55% of a high molecular weight copolymer of ethylene and vinyl acetate, or interpolymers of ethylene vinyl acetate and an organic acid when combined with the appropriate winding produces a baseball having excellent durability and playing characteristics.

Although a variety of ethylene vinyl acetate copolymer resins may be used in the construction of the baseball core center, ethylene vinyl acetate copolymers having polymerized acetate contents of about 14% to about 22%, and particularly 18% are most preferred. It has been found that the use of a compound sold under the trademark Elvax by the DuPont Company, when combined with the proper proportions of unsaturated monocarboxylic acid and windings produces a highly satisfactory baseball. Most preferably the center core of the baseball comprises about 50% Surlyn 8528 and 50% Elvax.

As stated previously, the center core material is developed as a foam during the molding process. This foaming process not only decreases the density of the core, thereby reducing the weight of the overall ball, but also results in core centers which when combined with the appropriate outer windings possess good playing characteristics including an acceptable co-efficient of restitution (rebound).

It is further noted that due to the method of foam injection molding, the foamed centers include air voids or cells which reduce in size and increase in number radially outwardly of its center. Generally, however, the center core of the baseball is more dense then that of the softball and has cells which are smaller in both size and number. In order to achieve this foam like configuration about 0.5% to about 2.0% of a heat activated blowing agent is mixed with the center material prior to molding. Preferably about 1% of a heat activated blowing agent is used in the construction of the softball core while somewhat less is used in the construction of the baseball.

Although any number of blowing agents may be employed in foaming the center material, the agents used must be compatible with the thermoplastic resins used. In addition, when choosing a blowing agent one must consider the activation temperature of the agent in conjunction with the melting and molding characteristics of the thermoplastic resins. Obviously the blowing agent must activate or decompose at approximately the temperature at which the resin melts. Heat activated blowing agents such as azo-N-nitroso carbonate, sulfonyl hydrazide and azodicarbonamide are well suited for use with the present invention since, not only are they compatible with the thermoplastic resins described above, but they can also be added directly to the extruder barrel during processing thereby facilitating control of the core density.

In order to improve the physical properties of the center core, small amounts of carriers and other compounds may be added to the blowing agents. It has been found that a mixture, by weight of about 65% to 75% of polyethylene, 10% to 15% sodium bicarbonate, 10% to 20% dicalcium phosphate and 2%–5% zinc sterate and about 1% silicon gel forms a preferred blowing agent mixture. It has also been found that the addition of the above described mixture results in a core having improved rebound characteristics.

The amount of blowing agent added to the thermoplastic resin will vary depending, not only on the type of copolymer used and the amount of heat applied, but also on the weight and size of ball desired. Generally, in the production of softball centers up to about 4% of the blowing agent mixture may be added to the resin material while in the production of baseball centers up to about 3% may be used.

The center composition may also contain small amounts of thermoplastic rubber modifiers which serve to generally upgrade the uniformity of the foam and improve the surface smoothness of the plastic center. Additionally, these modifiers tend to stabilize the shrink rate of the resin during cooling. Although the thermoplastic rubber modifiers may be used in conjunction with the construction of both the softballs and baseballs of the present invention, their use is more critical with respect to the softball core since the softball core is foamed to a greater extent. Moreover, since the baseball cores are more dense, then those of the softball, they have less of a tendency to shrink during cooling.

Although a large number of thermoplastic rubber modifiers are commercially available, it has been found that from about 2% to about 4% of a styrene-ethylene-butylene block copolymer added to the resin produces the desired characteristics of the plastic center. In order to effectuate a uniform blend, the thermoplastic rubber should be added to the thermoplastic resin in a finely divided or neat crumb granulation. The styrene-ethylene-butylene block copolymer sold by the Shell Chemical Company under the trademark Krayton is quite suitable in the practice of the present invention.

Small amounts of carbon black may also be added to the core center composition so as to enhance the physical properties and to achieve color identity. Again however, the addition of carbon black is less critical in the production of the baseball due to the density of the core. Indeed, in most instances carbon black need not be added in the production of the baseball core center. Generally, from about 0.2% to about 1.5% and preferably 1% of carbon black is added to the core center composition prior to extrusion and foam injection molding.

In addition to the above ingredients, the center composition may also include from about 2% to 10% and in some cases up to 15% of polyethylene. It has been found that small amounts of polyethylene acts as a lubricant, which aids the molten resin material to flow through the extruder barrel. Additionally, the polyethylene helps to control the rebound characteristics of the completed softball. The addition of more than 15% polyethylene, however, in either the softball or baseball results in a ball that has a tendency to develop compression-set or flat spots during prolonged use.

In order to achieve proper flight restriction on the balls of the present invention, a yarn winding is applied to the center. Although any yarn winding may be used the preferred winding includes cotton thread, polyester, nylon or any combination thereof. Preferably a combination of polyester and cotton blend strands is used.

In the practice of the softball of the present invention, the core winding includes from about $\frac{5}{8}$ to about 11/16 of an ounce of yarn windings. This softball winding consists preferably of two strands of 16 singles polyester/cotton blend yarn, two strands of 18 singles polyester/cotton blend yarn and one strand of 16 singles cotton yarn.

Similarly the winding of the baseball core may include cotton thread, polyester, nylon or any combination, but a combination of polyester and cotton strands is preferred. It has been found that about $\frac{1}{4}$ to about $\frac{3}{8}$ of an ounce of yarn in combination with the proper core composition described above yields a baseball having proper durability, sound and flight characteristics. The winding for the baseball preferably includes one strand of 18 singles cotton thread and one strand of 20 singles polyester thread.

The above winding compositions not only contain sufficient cotton to absorb the subsequently applied adhesive but also include sufficient polyester to give the necessary strength to the winding. These core windings, especially those of lighter weight yarn are parallel wound on the core center in order that sufficient tension can be used on the yarn without breakage.

Subsequent to the application of the winding, the wound center is immersed in a latex based adhesive. This adhesive not only serves to limit the rebound of the ball but also secures the windings to the plastic center so as to reduce shifting of the winding on the surface. Additionally, the adhesive aids in the adherence of the outer cover to the surface of the wound core.

An appropriately dipped winding allows a wide range of flexibility to control the rebound of the ball, since as will be explained further below, the dipping solution can be varied from a highly resilient natural latex, used in the construction of the baseball, to a specifically formulated low resilient slow recovery synthetic latex, used in the construction of the softball. The reason for the use of dipping solutions having differing formulas is based on the fact that the completed balls must have different playing characteristics particularly those dealing with sound and rebound. Indeed, the composition of the adhesive used to saturate the yarn winding is important to the total integrity and performance of the finished ball.

With respect to the softball, the latex adhesive comprises a slow recovery adhesive which helps control the rebound of the ball. This control is important since most leagues restrict the amount of rebound which a softball may have. The slow recovery adhesive used for the softball comprises, by volume about 45% to 55% of a vinyl acetate copolymer (52% solids); about 5% to 15% synthetic-latex with pigmentation; about 20% to 35% water; and about 3% to 10% of a surfactant. A preferred slow recovery adhesive composition for use in the construction of the softball of the present invention includes by volume approximately:

55%—vinyl acetate copolymer;
10%—synthetic latex w/pigmentation;
25%—water; and
10%—surfactant.

In accordance with the baseball, the adhesive dip comprises, by volume, about 60% to 70% natural latex emulsion having about 55% to 65% latex solids; about 5% to 15% synthetic-latex with pigmentation; about 15% to 25% water; and about 3% to 10% surfactant. A preferred adhesive composition used in construction of the baseball of the present invention includes by volume approximately:

68%—natural latex (55%-65% solids)
9%—synthetic latex with pigmentation
18%—water
5%—surfactant The wound core must be immersed in the adhesive for a sufficient period to allow the adhesive to fully saturate the winding. Generally, immersion from about 30 seconds to 3 minutes is sufficient for the adhesive to fully saturate the winding.

Figure 2:
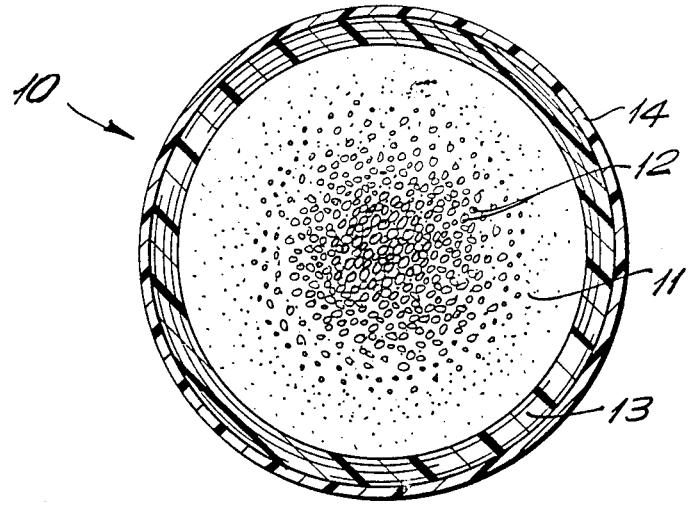
FIG. 2 is a cross sectional view of a ball constructed in accordance with the present invention.

Referring to FIG. 2 a cross sectional view of a ball constructed in accordance with the present invention is depicted generally by reference number 10. As can be seen, ball 10 comprises a foamed plastic core center 11 which is provided with a plurality of cells 12 which decrease in size and increase in number radially from the center. Surrounding core center 11 is core winding 13 which is heat fused to the surface of the core center 11. Thus, the core of this invention comprises the combination of center 11 and winding 13 fused thereto. The core is then encased by stitched cover 14. FIG. 1 depicts the completed ball having cover 14 surrounding the wound core.

In the method of the present invention the plastic center 11 is formed by introducing the above described proportions of thermoplastic resin and any other optional ingredients desired into a feeder drum or the like where a uniform particulate mixture is formed. The particulate mixture is then augered or transported by any conventional means to a device which preheats the material, prior to its introduction to the extruder. It has been found that the heating device disclosed in U.S. Pat. No. 3,013,298, issued on Dec. 19, 1961 and which is hereby included by reference is well suited for preheating the particulate mixture.

In the practice of the present method, the turntable of the device disclosed in the above identified patent is heated to a temperature of between 500° F. and 700° F. and the particulate mixture is introduced by gravity or other means onto the plate. It is noted that the speed of the turntable is adjusted so that the residence time of the particulate mixture is sufficient to soften without melting the thermoplastic resin. Generally, a speed of between 5-15 rpm is sufficient to preheat the resin material. Subsequent to preheating, the softened, but still particulate material is introduced into a standard extruder, where, at about 330° F. to 360° F. and preferably 340° F.-350° F., the thermoplastic material becomes molten and flowable.

As the molten material moves down the extruder barrel, the blowing agent is metered in. As stated above, the blowing agents utilized are heat decomposable and thus, when heated, yield gas such as carbon dioxide or nitrogen. The gas formed by the blowing agent in the extruder barrel creates some pressure which not only foams the material but also facilitates moving the molten material into an accumulator unit located at the exit end of the extruder barrel. As would be understood by one skilled in the art, the accumulator unit is adapted to measure a predetermined amount of extrudate. When the accumulator is filled, a valve to a spherical ball mold is automatically opened and the molten material passes through an injection nozzle into the mold cavity.

After filling, the mold is taken from the foam injection molding machine and introduced to a cooling unit so as to solidify the molten material. Since the mold is cooled from the outside, a smooth thin skin of themoplastic material is formed around the circumference of the plastic center. The method used to cool the mold may be any conventional method used in the extruder and foam injection molding art, as for example a simple water bath. Other methods include water spray, air or a combination of any of the above. It has been found that when using a water bath at approximately 50° F. to 70° F., immersion time of about one to five minutes enables the center to solidify a sufficient amount so that it can be removed from the mold without losing its spherical shape. It is most important that the plastic center not be removed from the mold prior to the formation of an outer skin sufficiently strong to prevent the blowing agent from rupturing the skin. When the plastic material is sufficiently cooled it is removed from the mold and the sprue from the slug is cut off. Generally, demolding takes place any where from about 5 to 15 minutes after the mold is removed from the water bath.

The finished softball center weighs approximately 4¼ to 4 ½ ounces and has a circumference of about 11 9/32 inches. Alternatively, the baseball center weighs approximately 4 to 4 ⅛ ounces and has a circumference of about 8½ inches. The center is then placed on a ball winding machine, whereupon the appropriate type and amount of winding is applied. The wound center is then introduced into a dip tank, containing the appropriate adhesive previously described.

The saturated core moves from the dip tank into a heated drying tunnel for approximately ½ to 2 hours at about 100° F. to 180° F. and preferably 130° F. to 150° F. The wound, dipped and dried core is then placed in an ironing press which is slightly smaller than the circumference of the ball. The proper combination of temperature and dwell time in the ironing press molds is critical since it must cause only the surface of the plastic center to liquefy just enough that, upon cool down, the entire bottom layers of winding are positively fused to the heretofore slippery surface of the plastic center.

Residence time in the press varies from approximately 5 to 30 seconds at temperatures of about 300° F. to 450° F. Generally, a residence time of about 20 seconds at approximately 375° F. for the softball cores and about 20 seconds at approximately 425° F. for the baseball cores provides sufficient liquidation of the plastic center surface to create a satisfactory bond between the plastic center and the yarn winding. In order to prevent the formation of a mold parting line on the winding, the cores may be pressed for about 10 seconds, rotated and then repressed an additional 10 seconds. After being ejected from the ironing press, the finished cores are checked for proper size and weight and are covered using a conventional, two-piece stitched cover.

The following examples are for the purpose of illustrating, but not limiting the present invention.

EXAMPLE 1

In the construction of a softball in accordance with the present invention, fifty pounds of Surlyn 9450 beads is dry mixed with 150 lbs. of surlyn 8528 beads for approximately 1O minutes. The resulting mixture is utilized in forming a core center composition comprising by weight about 95% of said resin composition, 4% styrene-ethylene-butylene-styrene block copolymer,(-Kraton G-1650), 1% sodium bicarbonate. All of the above ingredients, with the exception of the blowing agent, are mixed in a tumble blender at ambient temperature until a homogeneous particulate mixture is formed. The mixture is then preheated until the material begins to soften. The preheated materials are then introduced into an extruder where it is further heated to a molten and flowable state.

As the molten material passed through the extruder barrel, the blowing agent is metered in such that it represented approximately 1% of the final core center composition. Approximately 4⅜ ounces of the thermoplastic material, including the activated blowing agent contained therein, is then injected into an 11 9/32 inch spherical mold. The mold is cooled by immersion for approximately two minutes, in approximately 60° F. water bath. After removal from the bath, the plastic centers are demolded and cooled further using an air table at ambient temperatures for about seven minutes and then the sprue is cut.

The core center is then wound with approximately ⅝ ounces of a cotton/polyester yarn and the entire wound core immersed for two minutes in an adhesive dip which completely saturates the winding.

This adhesive dip is formed using the following quantities of materials:

| Batch | Ingredients |
|---|---|
| 27½ gallons | SEYCOREZ, E-242* |
| 5 gallons | synthetic-latex with pigmentation |
| 14 gallons | water |
| 3 gallons | soap |
| 3 gallons | ammonia |

*a vinyl acetate emulsion copolymer, containing 55% solids, sold by AZS Chemical Co.

After complete saturation, the wound core is placed into a heat tunnel for about 1 hour at a temperature of approximately 180° F. and from there to an ironing press where it is heated for approximately 20 seconds at 375° F. Thereafter, the completed, wound and fused core is covered with a conventional two piece cowhide cover.

The finished ball is checked for weight, size and roundness, all of which are satisfactory. Batting tests using a Dudley batting machine showed that the ball does not deform or fracture after a minimum of 300 hits against a concrete pad placed 25 feet from the batting machine. The ball also displays satisfactory rebound and proper sound characteristics when hit by the batting machine.

EXAMPLE II

Example I is repeated with the exception that the core center composition included 90% of the copolymer and 5% polypropylene. The completed ball is tested as above and exhibits excellent rebound, resilience sound and durability.

EXAMPLE III

Constructing a baseball in accordance with the present invention, a mixture of thermoplastic resin consisting of 100 lbs. of Elvax #450 and 100 lbs. of Surlyn 8528 is dry blended for about 12 minutes. The above mixture is then preheated until it begins to soften at which time it is introduced into an extruder where it is further heated to a molten and flowable state. As the molten material passes through the extruder barrel, a small amount of sodium bicarbonate is metered in such that it represented approximately 0.5% of the final core center composition. Approximately 4⅛ ounces of the thermoplastic material, including the activated blowing agent contained therein, is then injected into an 8½ inch spherical mold. The mold is then cooled as in Example I. After removal from the bath, the plastic centers are demolded and cooled further using an air table at ambient temperatures for about seven minutes and then the sprue is cut.

The core center is then wound with approximately ⅜ ounces of cotton and polyester yarn and the entire wound core immersed for two minutes in an adhesive dip which completely saturates the winding.

The adhesive dip is formed using the following quantities of materials:

| Batch | Ingredients |
|---|---|
| 36 gallons | NX226* |
| 5 gallons | 75-780 HV Yellow** |
| 10 gallons | water |

*a natural latex emulsion, containing 55%-65% latex solids, sold by the Major Chemical and Latex Corporation of Boston, Mass.

**A general synthetic latex based adhesive w/ clay pigmentation sold by the General Adhesives and Chemical Co. of Nashville, Tenn.

After complete saturation, the wound core is placed into a heat tunnel for about 1 hour at a temperature of approximately 180° F. and from there to an ironing press where it is heated for approximately 20 seconds at 425° F. Thereafter, the completed, wound and fused core is covered with a conventional two piece cowhide cover.

Since from the foregoing, the construction and advantages of the invention may be readily understood, further explanation is believed to be unnecessary. However, since numerous modifications will readily occur to those skilled in the art after a consideration of the foregoing specification and accompanying drawings, it is not intended that the invention be limited to the exact construction shown and described, but all suitable modifications and equivalents may be resorted to which fall within the scope of the appended claims.

Having described the invention, what I claim is:

1. A ball having a cover and core, said core comprising a spherical center and a winding wherein said center comprises at least 45% of a partially blown copolymer of at least one olefin with at least one unsaturated monocarboxylic acid and said winding is impregnated with a latex based adhesive, and said winding being heat fused to the spherical center.

2. The ball of claim 1, wherein the unsaturated monocarboxylic is a copolymer of ethylene and acrylic acid.

3. The ball of claim 2, wherein the spherical center further includes up to 55% of a high molecular weight resin selected from the group of copolymers of ethylene and vinyl acetate, and interpolymers of ethylene acetate and an organic acid.

4. The ball of claim 3, wherein said adhesive consists essentially by volume from about 65% to 85% of a latex emulsion and about 15% to 25% water.

5. The ball of claim 2, wherein said adhesive comprises by volume from about 45% to 55% of a vinyl acetate copolymer, about 5% to 15% synthetic latex, and about 20% to 35% water.

6. The ball of claims 4 or 5, wherein said adhesive further includes from about 3% to 10% of a surfactant.

7. The ball of claims 2 or 3, wherein said spherical center further includes a thermoplastic rubber.

8. The ball according to claim 7, wherein the thermoplastic rubber is a styrene-ethylene-butylene block copolymer.

9. The ball according to claim 2, wherein said spherical center includes from 2% to 15% of polyethylene.

10. The ball in accordance with claim 2, wherein the partially blown center mixture includes from about 0.1% to 1.5% carbon black.

11. A ball in accordance with claim 1, wherein the winding is selected from the group of yarn, cotton, polyester, nylon and combinations thereof.

12. A softball comprising a cover and a core having a spherical center and a winding, said center comprising one or more partially blown ethylene acrylic acid copolymers; said winding being impregnated with a slow recovery adhesive and fused to the center, said partially blown spherical center having a micro cellular structure wherein the cells increase in number and decrease in size radially outward from the center.

13. The softball of claim 12, wherein said adhesive consists essentially of about 45% to 55% of a vinyl acetate copolymer, about 5% to 15% synthetic latex, about 20% to 35% water and about 3% to 10% of a surfactant.

14. The softball of claim 12 which further includes about 2% to 4% of a styrene-ethylene-butylene block copolymer and about 0.2% to 1.5% carbon black.

15. A baseball comprising a cover and core, said core having a spherical center and a winding, wherein said center comprises a partially blown mixture of about 45% to about 55% of an ethylene acrylic acid copolymers and from 45% to about 55% of a high molecular weight resin selected from the group of copolymers of ethylene and vinyl acetate, and interpolymers of ethylene vinyl acetate and an organic acid; said winding being impregnated with a latex based adhesive and fused to the center, said partially blown center having a micro-cellular structure wherein the cells increase in number and decrease in size radially outward.

16. The baseball of claim 15, wherein said adhesive consists essentially of about 60% to 70% of a natural latex emulsion containing 55% to 65% latex solids; about 5% to 15% synthetic-latex; and about 15% to 25% water.

17. The baseball of claim 15 which further includes about 2% to 4% of styrene-ethylene-butylene block copolymer and about 0.2% to 1.5% carbon black.

18. A ball having a cover and core, said core consisting essentially of a spherical center and a winding wherein said center comprises at least 45% of a partially blown copolymer of at least one olefin with at least one unsaturated monocarboxylic acid and said winding is impregnated with a latex based adhesive, and said winding being heat fused to the spherical center.

19. A softball consisting essentially of a cover and a core having a spherical center and a winding, said center comprising one or more partially blown ethylene acrylic acid copolymers; said winding being impregnated with a slow recovery synthetic latex adhesive and fused to the center, said partially blown spherical center having a micro cellular structure wherein the cells increase in number and decrease in size radially outward from the center.

20. A baseball consisting essentially of a cover and core, said core having a spherical center and a winding, wherein said center comprises a partially blown mixture of about 45% to about 55% of an ethylene acrylic acid copolymer and from 45% to about 55% of a high molecular weight resin selected from the group of copolymers of ethylene and vinyl acetate, and interpolymers of ethylene vinyl acetate and an organic acid; said winding being impregnated with a natural latex based adhesive and fused to the center, said partially blown center having a micro cellular structure wherein the cells increase in number and decrease in size radially outward.

* * * * *